US008007142B2

(12) United States Patent
Ku et al.

(10) Patent No.: US 8,007,142 B2
(45) Date of Patent: Aug. 30, 2011

(54) LAMP WITH FASTENING DEVICE

(75) Inventors: Chin-Long Ku, Taipei Hsien (TW); Qing-Hai Ruan, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 139 days.

(21) Appl. No.: 12/624,420

(22) Filed: Nov. 24, 2009

(65) Prior Publication Data

US 2011/0063828 A1 Mar. 17, 2011

(30) Foreign Application Priority Data

Sep. 16, 2009 (CN) ..... 2009 1 0307105

(51) Int. Cl.
*F21V 11/00* (2006.01)

(52) U.S. Cl. ..... 362/368; 362/370; 362/372; 362/431; 248/125.2

(58) Field of Classification Search ..... 362/368, 362/370, 371, 372, 431; 248/125.2
See application file for complete search history.

(56) References Cited

U.S. PATENT DOCUMENTS

| | | | | |
|---|---|---|---|---|
| 1,782,660 | A * | 11/1930 | Meyer | 248/413 |
| 5,513,477 | A * | 5/1996 | Farber | 52/848 |
| 6,164,803 | A * | 12/2000 | Reniger et al. | 362/477 |
| 6,784,357 | B1 * | 8/2004 | Wang | 136/244 |
| 7,448,774 | B2 * | 11/2008 | Konuma | 362/309 |
| 2002/0126492 | A1 * | 9/2002 | Ching | 362/413 |
| 2003/0202352 | A1 * | 10/2003 | Olson | 362/272 |
| 2007/0247859 | A1 * | 10/2007 | Haddad et al. | 362/431 |

* cited by examiner

*Primary Examiner* — Ali Alavi
(74) *Attorney, Agent, or Firm* — Altis Law Group, Inc.

(57) ABSTRACT

A lamp includes a lamp head, a lamp rod and a fastening device fixing the lamp head onto the lamp rod. The fastening device includes a tube-shaped lamp seat extending from the lamp head, a tightening device disposed in the lamp seat, a connecting device connecting the tightening device to the lamp seat, and a locking device mounted to the lamp seat. The tightening device includes an inner face and an outer face opposite to the inner face. The inner face of the tightening device and an inner face of the lamp seat sandwiching an end of the lamp rod therebetween. The tightening device can move along a radial direction of the lamp seat. The locking device presses the tightening device toward the end of the lamp post to urge the tightening device to tightly press the lamp rod.

15 Claims, 5 Drawing Sheets

LAMP WITH FASTENING DEVICE

BACKGROUND

1. Technical Field

The disclosure relates to illumination devices and, particularly, to a lamp with a fastening device which can firmly and reliably secure a lamp head to a lamp rod of the lamp.

2. Description of Related Art

A conventional lamp such as a street lamp generally includes a lamp head, and a tube-shaped lamp seat extending outwardly from the lamp head and connected to a lamp rod located on a predetermined position along a street and fixed to the ground beside the street. The lamp seat defines a plurality of threaded holes in a wall thereof. An end of the lamp rod is inserted in the lamp seat. A plurality of screws are screwed into the threaded holes of the lamp seat and press the end of the lamp rod to thereby secure the lamp seat to the lamp rod. However, due to a severe environmental condition around the street lamp, the screws may be corroded after a period of time, whereby the lamp head can no longer be securely fixed to the lamp rod, and the lamp head is possible to separate from the lamp rod, which results in a malfunction of the street lamp or even a danger to vehicles and pedestrians of the street.

What is needed, therefore, is a lamp with a fastening device which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
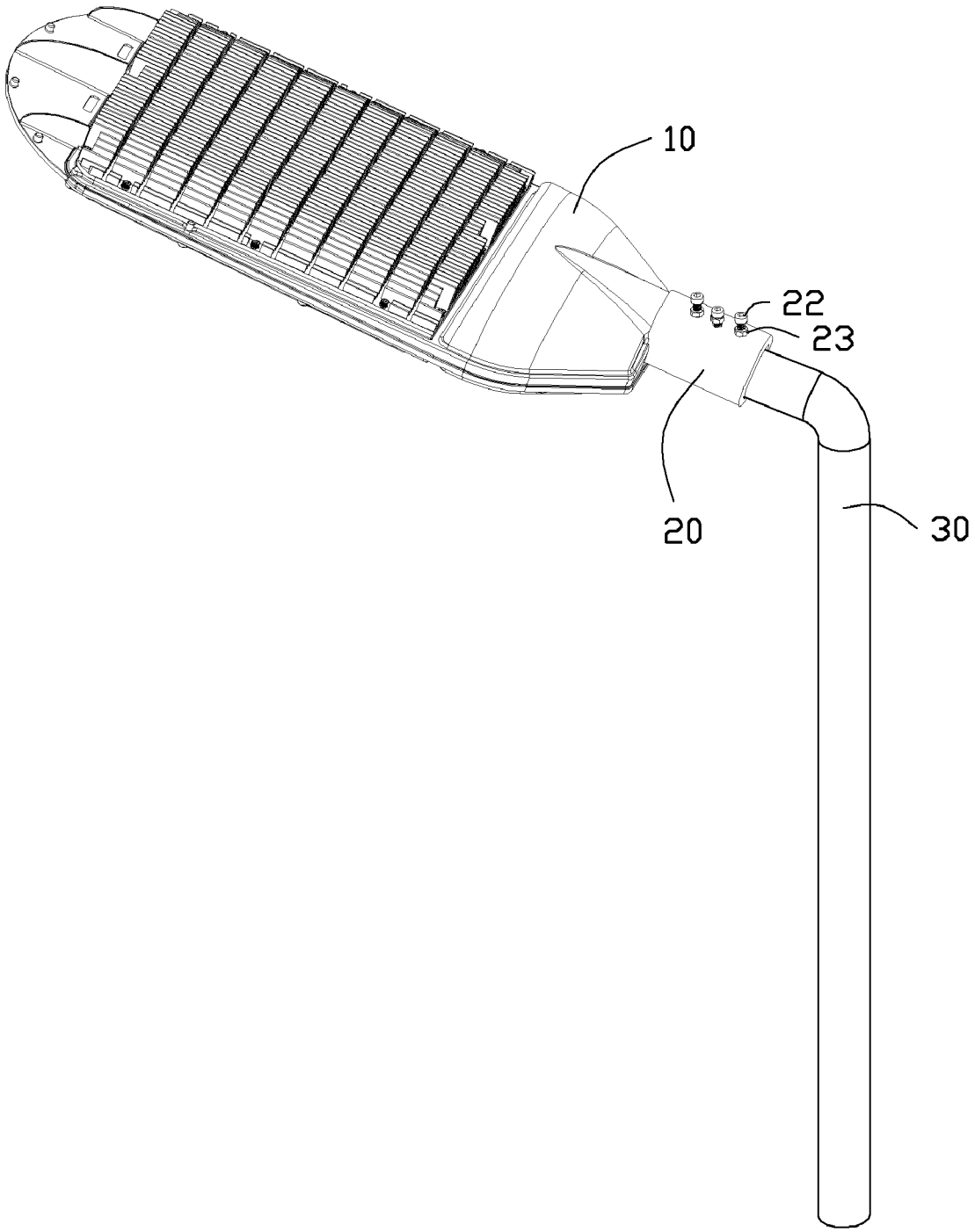
FIG. 1 is an isometric, assembled view of a lamp in accordance with a first embodiment of the disclosure.

Referring to FIG. 1, a lamp in accordance with a first embodiment of the disclosure includes a lamp head 10, a lamp rod 30 and a fastening device fastening the lamp head 10 to the lamp rod 30. The fastening device includes a lamp seat 20 integrally extending from an end of the lamp head 10.

The lamp head 10 includes a head body (not labeled) and a light source such as an LED module (not shown) contained in the head body of the lamp head 10.

Figure 2:
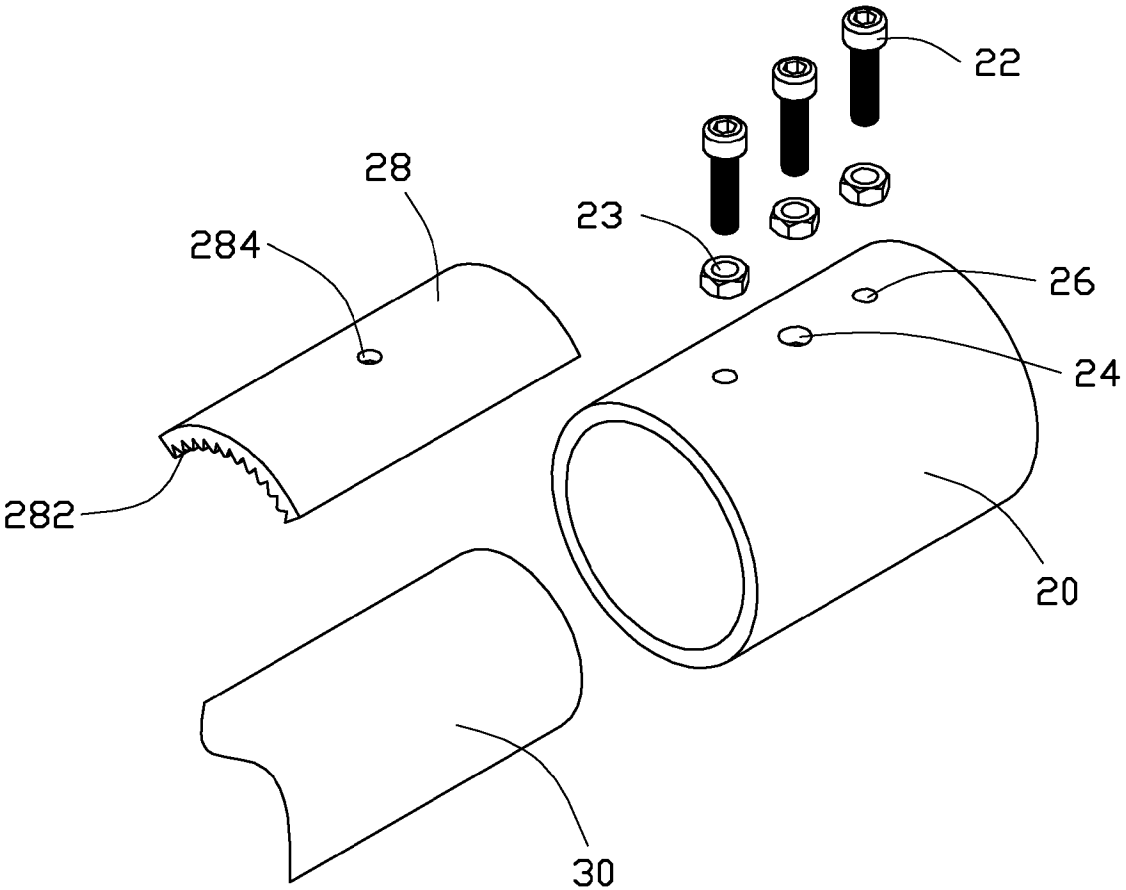
FIG. 2 is an isometric, exploded view of a fastening device of the lamp of FIG. 1.

Also referring to FIG. 2, the lamp seat 20 is tube-shaped and made of metal such as aluminum, copper or an alloy thereof. An end of the lamp rod 30 is inserted in the lamp seat 20. The lamp seat 20 defines three spaced holes in a top and along an axial direction thereof, wherein a middle one of the three holes is a through hole 24 for a connecting device extending therethrough, and the other two holes at two sides of the through hole 24 are two threaded holes 26 for threadedly engaging with two locking devices. Each of the connecting and locking devices includes a screw 22 and a nut 23 threadedly engaging with the screw 22. A screw shaft of one of the screws 22 has a diameter smaller than that of the through hole and extends through the through hole 24. Screw shafts of the other two screws 22 threadedly engage in the threaded holes 26.

Figure 3:
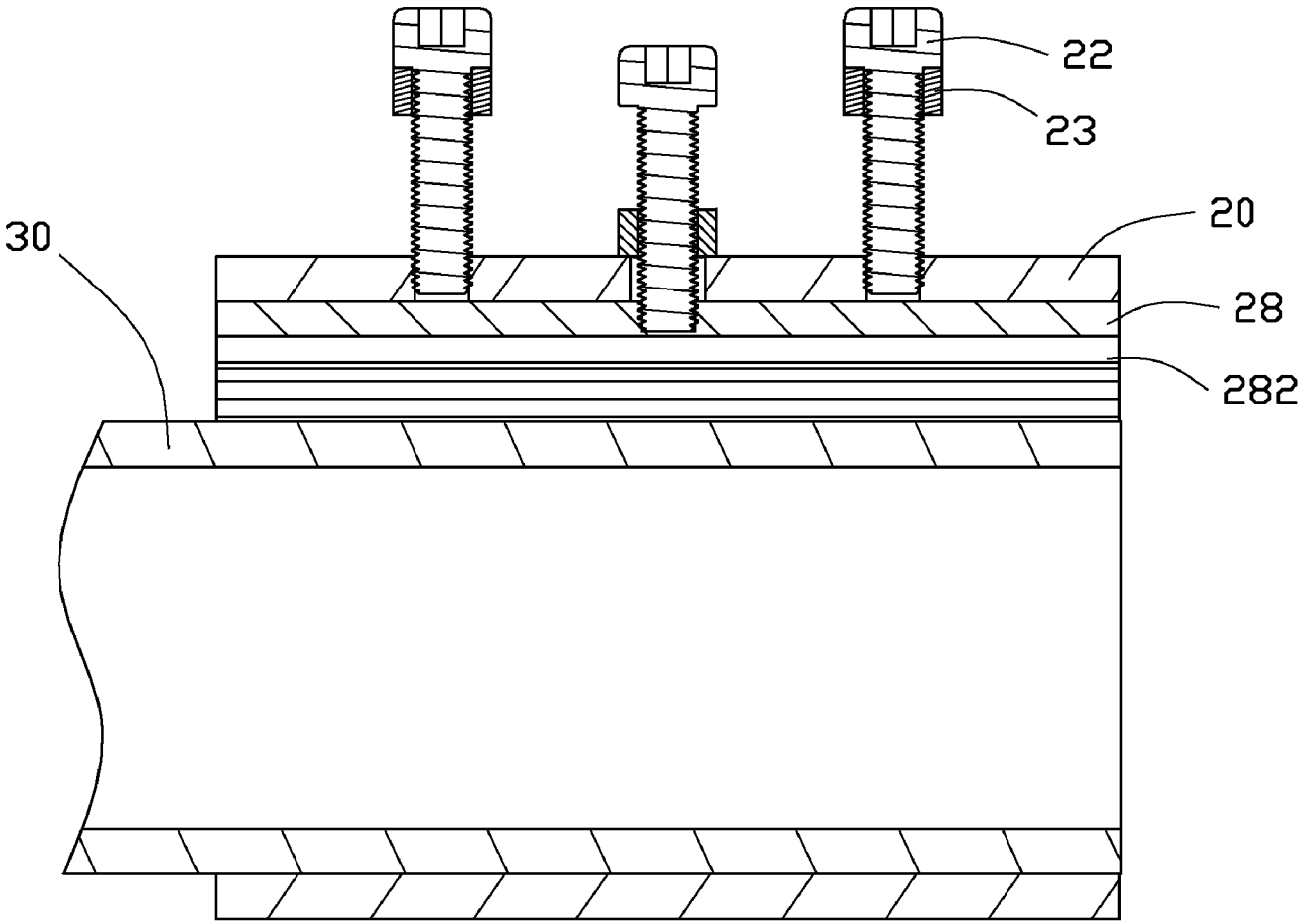
FIG. 3 is a cross-sectional view of the lamp of FIG. 1, with the fastening device thereof in a released position.
Figure 4:
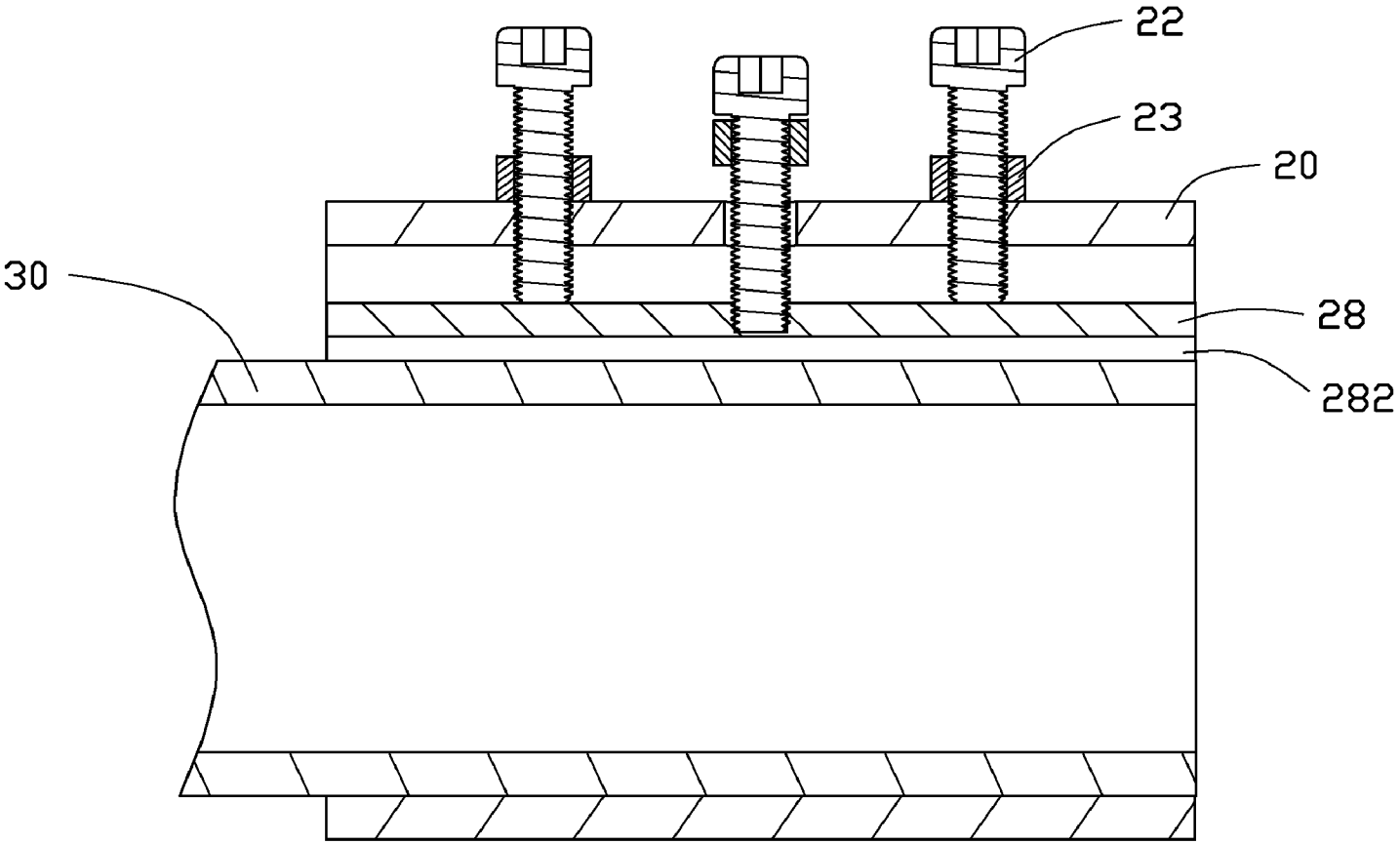
FIG. 4 is a view similar to FIG. 3, wherein the fastening device is moved to a locked position.

Also referring to FIGS. 3-4, a tightening device 28 is disposed in the lamp seat 20 and located between an inner face of the lamp seat 20 and an outer face of the lamp rod 30. The tightening device 28 is an arced plate and made of a material such as metal or rubber, having a degree of elasticity. The tightening device 28 includes an inner face and an outer face opposite to the inner face. The inner face of the tightening device 28 and the inner face of the lamp seat 20 cooperatively form a sandwiching room for receiving the end of the lamp rod 20. A plurality of teeth-shaped bulges 282 protrude from the inner face of the tightening device 28, and a threaded hole 284 corresponding to the through hole 24 of the lamp seat 20 is defined in a central part of the outer face of the tightening device 28. All tips of the bulges 282 of the tightening device 28 are located in an arc of a circle which has a radius equal to that of the outer face of the lamp rod 30, whereby all the tips of the bulges 282 can sufficiently and intimately contact with the outer face of the lamp rod 30 so that a friction of an engagement between the tightening device 28 and the outer face of the lamp rod 30 is increased. The outer face of the tightening device 28 is located at an arc of a circle which has a radius equal to that of the inner face of the lamp seat 20 so that the outer face of the tightening device 28 can sufficiently and intimately contact with the inner face of the lamp seat 20.

The screw 22 of the connecting device extends through the through hole 24 of the lamp seat 20 and engages in the threaded hole 284 of the tightening device 28 to connect the tightening device 28 with the lamp seat 20. Since the diameter of the through hole 24 of the lamp seat 20 is larger than that of the screw shaft of the screw 22, the connecting device can bring the tightening device 28 to move along a radial direction of the lamp seat 20. The nut 23 of the connecting device can be screwed onto an appropriate position of the screw shaft of the screw 22 of the connecting device to control an extent of the tightening device 28 moving along the radial direction of the lamp seat 20. The screws 22 of the two locking devices are respectively engaged in the two threaded holes 26 of the lamp seat 20, and distal ends of the screws 22 of the two locking devices extend through the threaded holes 26 and abut against the outer face of the tightening device 28 (shown in FIG. 4), so that a radial pressure can be exerted on the tightening device 28 when rotating the screws 22 of the two locking devices downwardly along the radial direction of the lamp seat 20 into the lamp seat 20.

In use, the tightening device 28 is pulled upwardly by the screw 22 of the connecting device and contacts the inner face of the lamp seat 20. The nut 23 of the connecting device is rotated to move toward the lamp seat 20 until the nut 23 contacts the outer face of the lamp seat 20 (shown in FIG. 3); thus, the tightening device 28 is fixed relative to the lamp seat 28. The end of the rod 30 is received in the sandwiching room formed by the inner face of the tightening device 28 and the inner face of the lamp seat 20. The nut 23 of the connecting device is then rotated to move upwardly to make the tightening device 28 together with the screw 22 of the connecting device fall downwardly until the tightening device 28 contacts with the end of the lamp rod 30, in which the nut 23 of the connecting device is located above an outer face of the lamp seat 20. Then the two screws 22 at two sides of the through hole 24 are rotated toward the lamp seat 20 to tightly press the outer face of the tightening device 28, and the tips of the bulges 282 of the tightening device 28 tightly snap the end of the lamp rod 30 simultaneously. The two nuts 23 at two sides of the through holes 24 are rotated downwardly and contact the outer face of the lamp seat 20 to further secure the two screws 22 of the two locking devices in position.

According to the disclosure, the tightening device 28 is disposed between the end of the lamp rod 30 and the lamp seat 20, after the end of the lamp rod 30 is inserted in the lamp seat 20. Then the screws 22 of the locking devices screwed in the lamp seat 20 are rotated to tightly press the tightening device 28, and the tightening device 28 is urged to tightly press the lamp rod 30 simultaneously. Thus the lamp seat 20 is prevented from moving relative to the lamp rod 30 and securely connected to the end of the lamp rod 30.

Figure 5:
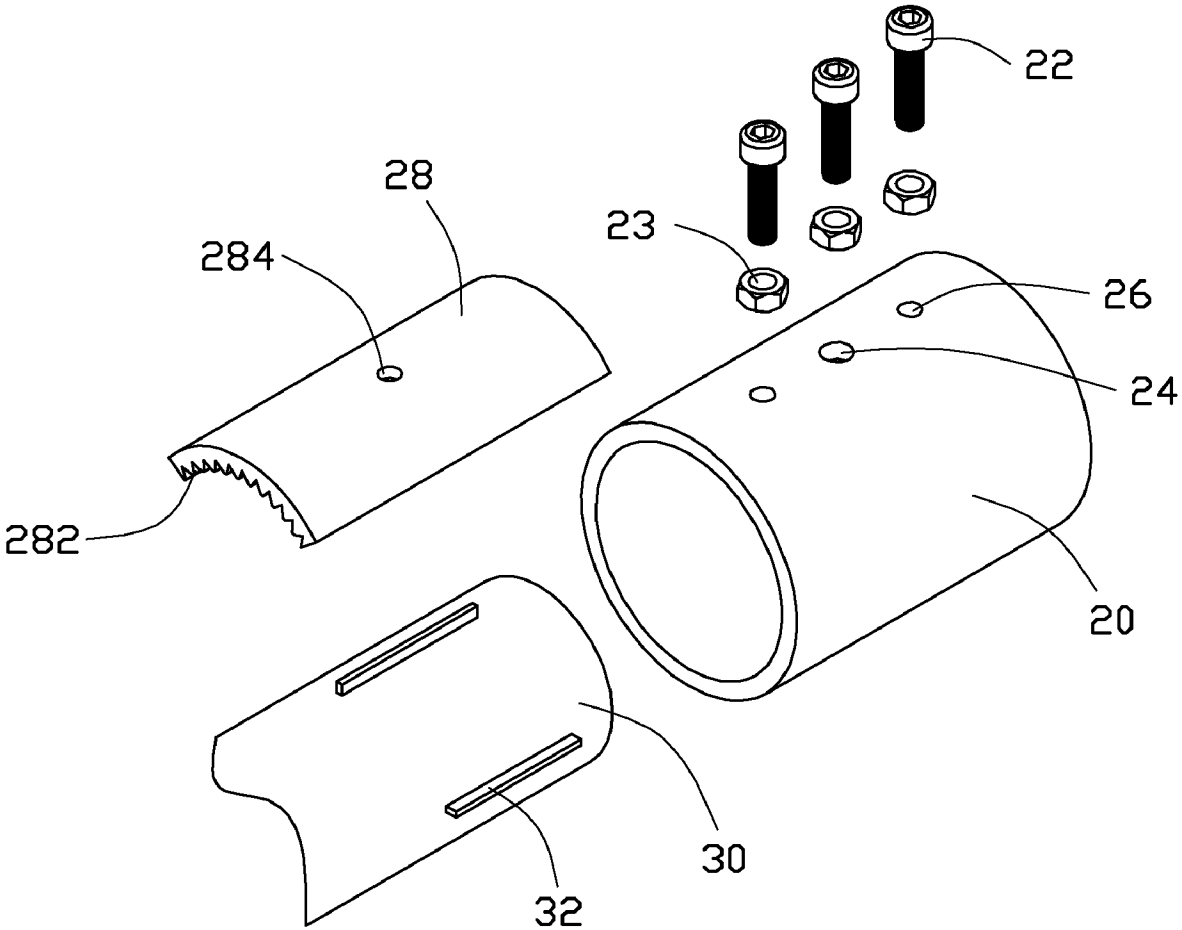
FIG. 5 is an isometric, exploded view of a lamp in accordance with a second embodiment of the disclosure.

FIG. 5 shows a lamp in accordance with a second embodiment of the disclosure. The second embodiment of the disclosure is similar to the first embodiment, except that the lamp rod 30 has two spaced protrusions 32 protruding from the outer face thereof for engaging with the tightening device 28. In use, the two protrusions 32 of the lamp rod 30 can block two sides of the tightening device 28 to prevent the tightening device 28 from rotating around the lamp rod 30. Thus, a more secure connection between the end of the lamp rod 30 and the lamp seat 20 of the lamp head of the lamp is obtained.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. A fastening device adapted for connecting a lamp head to a lamp rod of a lamp comprising:

a tube-shaped lamp seat adapted for extending from the lamp head;

a tightening device disposed in the lamp seat and comprising an inner face and an outer face opposite to the inner face, the inner face of the tightening device and an inner face of the lamp seat cooperatively defining a sandwiching room adapted for receiving an end of the lamp rod;

a connecting device movably connecting the tightening device to the lamp seat; and a locking device movably mounted to the lamp seat for abutting against the outer face of the tightening device;

wherein the tightening device and the connecting device are moveable along a radial direction of the lamp seat to cause the tightening device to move toward the sandwiching room, and the locking device is also moveable along the radial direction for exerting a force on the outer face of the tightening device to cause the tightening device to move toward the sandwiching room along the radial direction of the lamp seat.

2. The fastening device as claimed in claim 1, wherein a plurality of teeth-shaped bulges protrude from the inner face of the tightening device.

3. The fastening device as claimed in claim 1, wherein a threaded hole is defined in the outer face of the tightening device, the lamp seat defining a through hole corresponding to the threaded hole, the connecting device extending through the through hole and being screwed in the threaded hole.

4. The fastening device as claimed in claim 3, wherein the connecting device screwed in the tightening device comprises a screw and a nut screwed on screw, and the nut is located at an outside of the lamp seat.

5. The fastening device as claimed in claim 1, wherein the lamp seat defines a threaded hole at a position over the tightening device, and the locking device is screwed through the threaded hole of the lamp seat for abutting against the outer face of the tightening device.

6. The fastening device as claimed in claim 5, wherein the locking device comprises a screw and a nut screwed on the screw of the locking device, and the nut of the locking device contacts an outer face of the lamp seat.

7. A lamp comprising:

a lamp head comprising a light source therein;

a lamp rod; and a fastening device fixing the lamp head to the lamp rod and comprising:

a tube-shaped lamp seat extending from an end of the lamp head;

a tightening device disposed in the lamp seat and comprising an inner face and an outer face opposite to the inner face, the inner face of the tightening device and an inner face of the lamp seat cooperatively sandwiching an end of the lamp rod therebetween, the end of the lamp rod extending into the lamp seat;

a connecting device extending along a radial direction of the lamp seat through the lamp seat to connect the tightening device to the lamp seat; and a locking device movably mounted to the lamp seat and abutting against the outer face of the tightening device;

wherein the locking device exerts a force on the outer face of the tightening device along the radial direction of the lamp seat to urge the tightening device to tightly press the end of the lamp rod.

8. The lamp as claimed in claim 7, wherein a plurality of teeth-shaped bulges protrude from the inner face of the tightening device and engage with the end of the lamp rod.

9. The lamp as claimed in claim 8, wherein all tips of the bulges of the tightening device are located in an arc of a circle which has a radius equal to that of an outer face of the lamp rod.

10. The lamp as claimed in claim 7, wherein the lamp rod has two spaced protrusions protruding from an outer face thereof, and two sides of the tightening device are blocked by the two protrusions.

11. The lamp as claimed in claim 7, wherein a threaded hole is defined in the outer face of the tightening device, the lamp seat defining a through hole, the connecting device extending through the through hole and being screwed in the threaded hole.

12. The lamp as claimed in claim 11, wherein the connecting device screwed in the tightening device comprises a screw and a nut screwed on screw, and the nut is located at an outside of the lamp seat, the screw screwed in the tightening device.

13. The lamp as claimed in claim 7, wherein the lamp seat defines a threaded hole at a position over the tightening device, and the locking device is screwed in the threaded hole of the lamp seat and abuts against the outer face of the tightening device.

14. The lamp as claimed in claim 13, wherein the locking device comprises a screw and a nut screwed on the screw of the locking device, and the nut of the locking device contacts an outer face of the lamp seat, the screw of the locking device screwed in the threaded hole of the lamp seat.

15. The lamp as claimed in claim 7, wherein the outer face of the tightening device is located at an arc of a circle which has a radius equal to that of the inner face of the lamp seat.

* * * * *